United States Patent [19]

Phares et al.

[11] 4,002,038

[45] Jan. 11, 1977

[54] METHOD AND APPARATUS FOR RAPID ERECTION OF OFFSHORE TOWERS

[75] Inventors: Lindsey J. Phares, Sugar Land; George J. Gendron, Houston, both of Tex.

[73] Assignee: Raymond International Inc., Houston, Tex.

[22] Filed: Oct. 6, 1975

[21] Appl. No.: 620,203

[52] U.S. Cl. ..... 61/91

[51] Int. Cl.[2] ..... E02B 17/00

[58] Field of Search ..... 61/46.5, 46

[56] References Cited

UNITED STATES PATENTS

| | | | |
|---|---|---|---|
| 2,857,744 | 10/1958 | Swiger et al. | 61/46.5 |
| 2,941,369 | 6/1960 | Quirin | 61/46.5 |
| 3,874,180 | 4/1975 | Sumner | 61/46.5 |

*Primary Examiner*—Jacob Shapiro
*Attorney, Agent, or Firm*—Fitzpatrick, Cella, Harper & Scinto

[57] ABSTRACT

A platform is raised from water level up to the tops of prepositioned template legs by means of jacking units comprising jacking mechanisms and jacking legs mounted near the upper ends of the template legs and extending down to the platform. Bridge beams of open framework construction span the distances between the upper ends of the template legs and these bridge beams provide support for the jacking units as well as reinforcement for the platform when it has been raised.

4 Claims, 13 Drawing Figures

METHOD AND APPARATUS FOR RAPID ERECTION OF OFFSHORE TOWERS

CROSS REFERENCE TO RELATED APPLICATION

This application discloses subject matter disclosed in copending United States patent application Serial No. 620,253, filed Oct. 6, 1975 in the name of George J. Gendron, and entitled Bridge Beam Tower Erection Method and Apparatus.

BACKGROUND OF THE INVENTION

1. Field of the Invention

This invention relates to the erection of structures and more particularly it concerns novel techniques for the construction of offshore towers and platforms such as are used in exploration and recovery of resources such as oil from beneath the sea bed.

2. Description of the Prior Art

Offshore towers and platforms of the type to which the present invention pertains are shown in U.S. Pat. No. 3,857,247 to Lindsey J. Phares and in U.S. Pat. No. 3,876,181 to Joseph E. Lucas. In both these patents there is described a two component system comprising a template or tower and a platform or deck, which are separately floated or carried by barge out to a desired offshore location. When the template arrives on location it is affixed in upright or vertical position to the sea bed with its legs extending up well beyond the water surface. The deck or platform is then positioned between the tower legs and is jacked up along the legs so that it is clear of the water surface and of all wave action. The platform is then pinned to the template and drilling and production operations are then carried out from the stably mounted, elevated platform.

Both the Phares and Lucas patents show arrangements for mounting jacking tubes to be suspended from the upper ends of the template legs so they extend down alongside the legs to the platform. Jacking mechanisms are provided on the platform to grip the jacking legs and pull the platform up via the jacking legs to the top of the template legs. After the elevated platform is secured to the template the jacks and jacking legs may be removed for use in the erection of another offshore tower.

SUMMARY OF THE INVENTION

The present invention provides improvements to the above described offshore tower erection techniques. More specifically, the present invention permits a more efficient and lower cost platform structure that has heretofore been necessary. That is, the platform structure may be of lighter weight and less rigid construction than previous platforms. In addition, with the present invention, a platform, once positioned adjacent the template, is made ready for a jacking up operation in a much shorter time than has heretofore been necessary. This is important because during the time the platform is riding on the water adjacent the template legs it is subject to the action of the sea and is vulnerable to damage should the sea conditions become severe.

According to the present invention there is provided a novel method for erecting an offshore tower platform in which a template, having at least one of vertical template leg, is positioned on the sea floor so that the template leg extends up above the sea level. The template is provided with jacking mechanism mounting means connected to the upper end of the template leg.

A platform is floated out to the thus positioned template adjacent the template leg. A jacking leg is then connected to extend down from a jacking mechanism on the jacking mechanism mounting means and to be connected to the platform. The jacking mechanism is then operated to pull the jacking leg upwardly to raise the platform clear of the water. This technique allows the platform to be of more compact construction than is required in prior art arrangements where jacking mechanisms, jacking legs and their associated power supplies and auxiliary equipment must be provided on the platform.

According to another aspect of the present invention there is provided a novel offshore tower construction arrangement suitable for rapid elevation of a platform up on a template. This novel offshore tower construction arrangement comprises a template including at least one vertical template leg which extends up above the surface of the sea when the template is secured to the sea floor. A mounting member is connected to the upper end of the template leg. A platform member is constructed to be positioned adjacent the template leg and to be lifted upwardly therealong clear of the water. A jacking mechanism is secured to the mounting means on the template leg; and a jacking leg extends from the jacking mechanism down to the platform and is secured thereto. Operation of said jacking mechanism pulls up the jacking leg and lifts the platform clear of the water. It will be appreciated that no special provisions need to be made on the platform for jacking mechanisms. Instead the platform need only accomodate a connection to the jacking leg and therefore it may be designed strictly for its use on the tower and not for use as a self lifting device.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 9 is a view similar to FIG. 7 but showing the platform in fully raised condition;

DETAILED DESCRIPTION OF THE PREFERRED EMBODIMENTS

Figure 1:
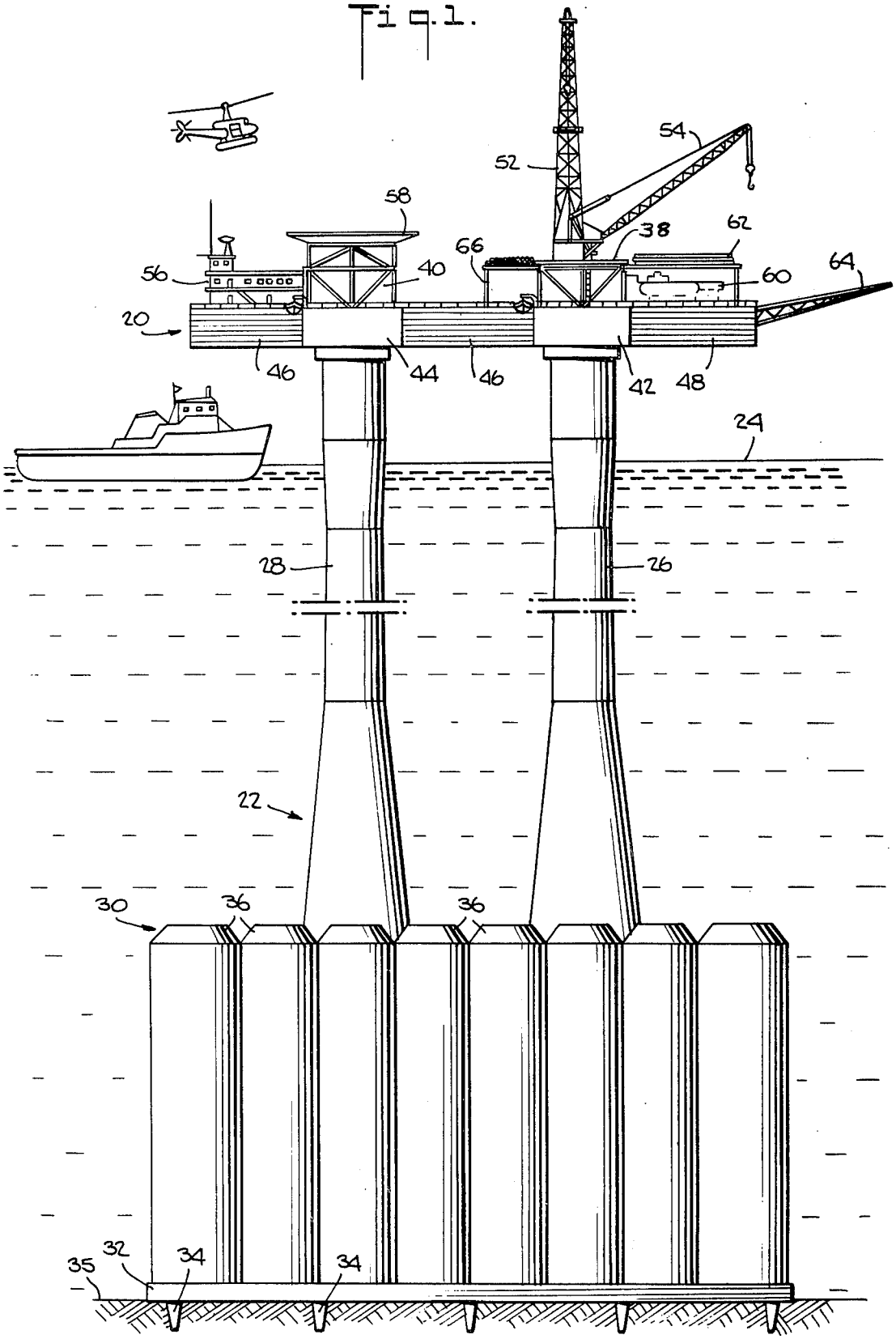
FIG. 1 is an elevational view of an offshore tower structure in which the present invention is embodied.

The offshore tower structure of FIG. 1 comprises a platform 20 which is held, by means of a template 22, in stationary position up above a sea surface 24 so as to be free of waves and sea currents.

The template 22 comprises forward and rearward pairs of vertical template legs 26 and 28 which extend up from a base 30. The base 30, in turn, comprises a base plate 32 which is pinned, as by anchor piles 34, to a sea bed 35, and a cluster of tubular elements 36 which extend upwardly from the plate 32 to surround the lower portion of the vertical legs 26 and 28.

Forward and rearward bridge beams 38 and 40, of trusslike open framework construction, extend across and span the distance between the upper ends of the forward and rearward legs respectively. These bridge beams are secured to pedestals 42 and 44 on top of the legs 26 and 28.

Figure 2:
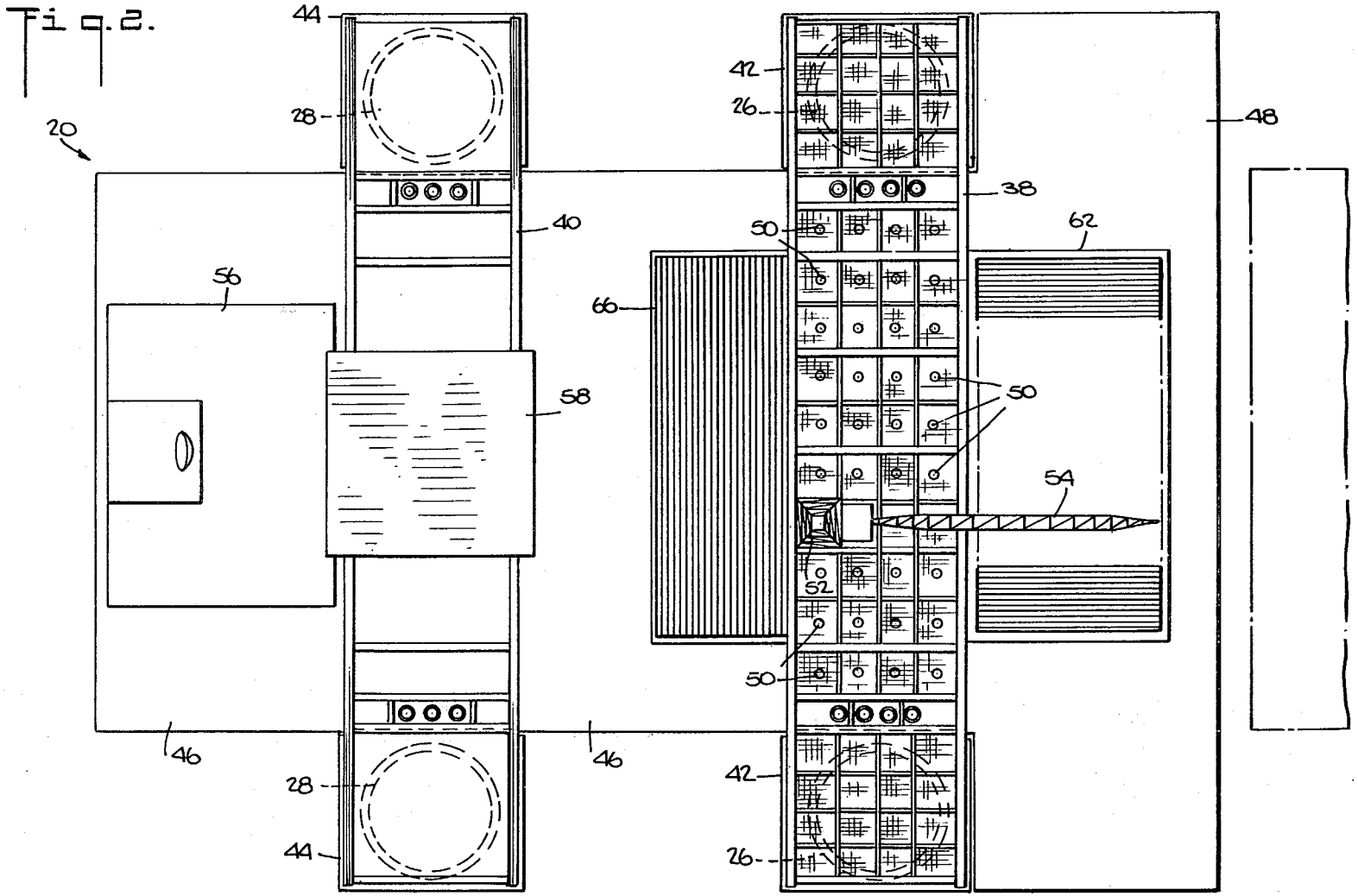
FIG. 2 is a top plan view of the offshore tower structure of FIG. 1.

As shown in FIGS. 1 and 2, the platform 20 is of expansive, generally flat configuration; and in plan view it is shaped as a T, with a base portion 46 and a cross portion 48. The base portion 46 of the T shaped platform extends lengthwise between and beyond the forward and rearward pairs of legs 26 and 28 and in its widthwise direction it extends the full distance between the corresponding legs of each pair. The cross portion 48 of the T shaped platform extends out forwardly and laterally beyond the forward legs 26.

The platform 20 is secured to the bridge beams 38 and 40 along their length; and consequently it is stiffened and strengthened by them. Because of this, the platform, although expansive in size, may be made of lighter construction than would have been necessary if the platform had to bridge the entire distance between the template legs without external bracing.

The offshore tower structure shown in FIGS. 1 and 2 is arranged for oil well drilling. As can be seen in FIG. 2, the forward bridge beam 38 is formed to define a grid like array of drilling locations 50 and to support a drilling tower 52 above different ones of those locations for exploratory drilling. The forward bridge beam 38 also supports a tower crane 54 which is used to position additional lengths of drill pipe in the tower 52.

Although the basic operative elements, i.e. the drilling tower 52 and the tower crane 54, are supported on the bridge beam 38, the platform 20 is required to support personnel, auxiliary equipment and supplies. Thus, as can be seen in FIGS. 1 and 2, there is provided a crew quarters 56 at the outer end of the platform base portion 46, and a helicoptor landing platform 58 atop the rearward bridge beam 40. Power generating and control equipment 60 is arranged on the platform cross portion 48 and a drill pipe storage ledge 62 is constructed thereabove. A supply hoist 64 is also mounted along the forward edge of the platform cross portion 48 for bringing supplies and equipment up from ship or barges moored to the template. A tower and crane positioning ledge 66 is constructed on the platform 20 just behind the forward bridge beam 38. This ledge accomodates the drilling tower 52 and the tower crane 54 when the platform 20 is being moved into position on the template or when it is being dismantled from the template.

FIGS. 3–9 illustrate the manner of erecting the above described offshore tower at a desired location in the sea. As can be seen in the phantom outline portion of FIG. 3 the template 22 is towed, while floating, to a desired location; and it is then sunk to the sea bed 35 when it has arrived at this location. The flotation control of the template 22 can be carried out by external means (not shown) attached to it, or the template legs 26 and 28, and the tubular elements 36 may be hollow and selectively floodable. After the template has been sunk to the sea bottom, it is secured there by installation of the anchor piles 34.

Figure 3:
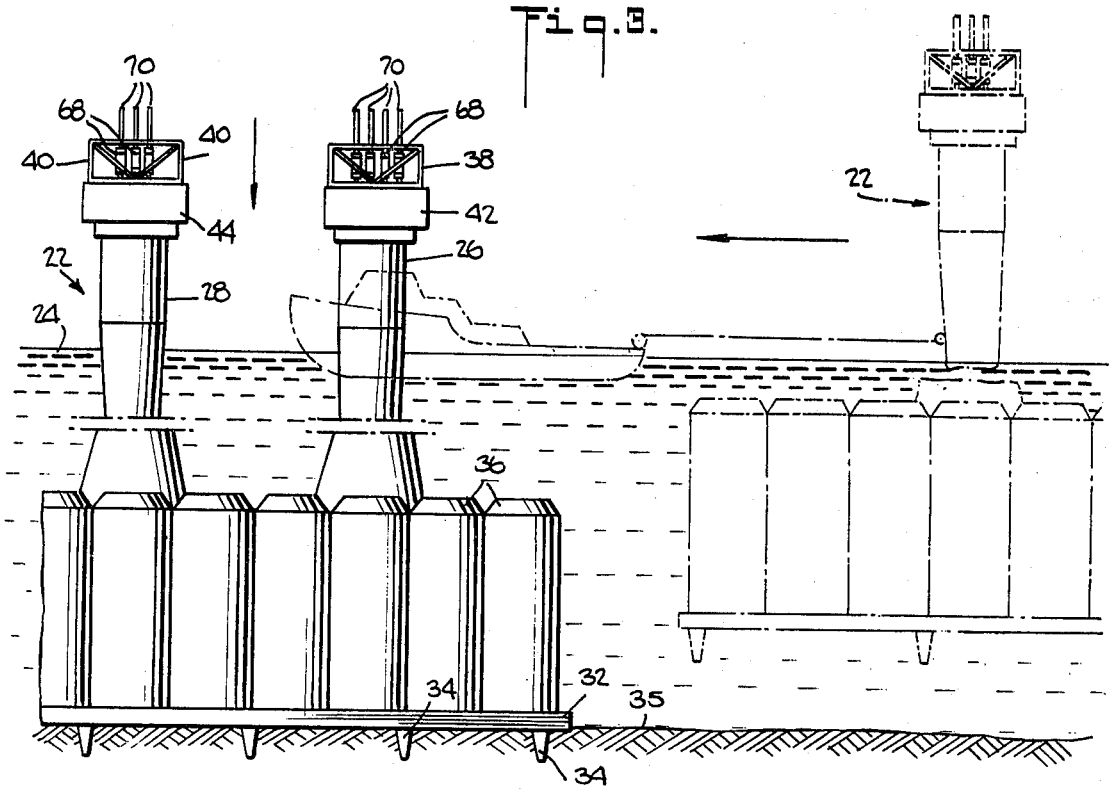
FIG. 3 is a side elevational view showing the placement of a template portion of the offshore tower of FIG. 1 as a first step in the erection of the tower.

It will be noted from FIG. 3 that the pedestals 42 and 44 and the bridge beams 38 and 40 are pre-assembled to the upper ends of the template legs 26 and 28 before the template is towed out to its desired location. Since the bridge beams 38 and 40 are of open framework construction they are relatively light in weight and are of minimum bulk. Therefore they do not offer appreciable resistance to towing nor do they substantially affect balance or buoyancy of the template during the towing operation. In fact, the bridge beams 38 and 40 actually brace the upper ends of the template legs so that is can better withstand the rigors of sea and wind action during the towing operation. On the other hand, if the template 22 were towed with the platform 20 attached, the platform would be subject to wind and/or sea action, which would overstress the structure. Moreover, the structure would not be stable in floating condition and would be likely to capsize.

It will also be noted in FIG. 3 that there are provided within each of the bridge beams 38 and 40, a plurality of jacking mechanisms 68 and associated rigid tubular jacking legs 70. The bridge beams 38 and 40 thus serve as mounting members on the template 22 for the jacking mechanisms 68. This arrangement of jacking mechanisms and jacking tubes permits rapid and convenient interconnection between the template and platform for lifting of the platform to its proper height, as will be explained more fully hereinafter.

Figure 4:
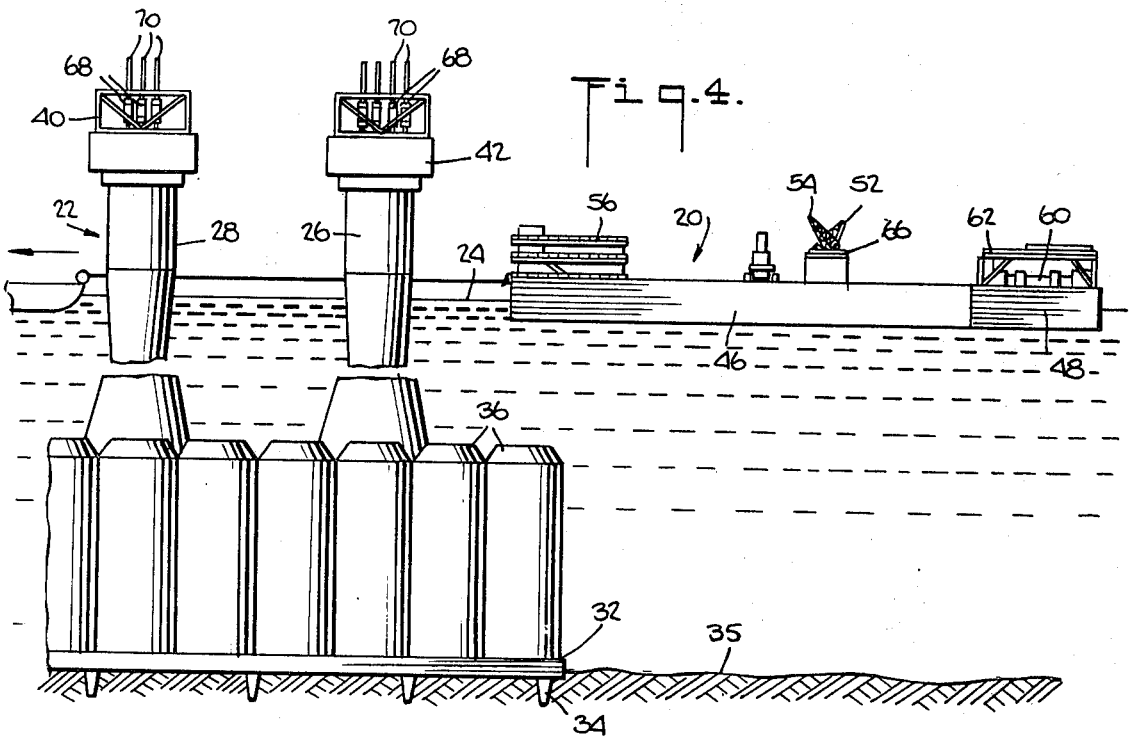
FIG. 4 is a view similar to FIG. 3 but showing the positioning of a platform at the template portion as a second step in the erection of the offshore tower of FIG. 1.
Figure 5:
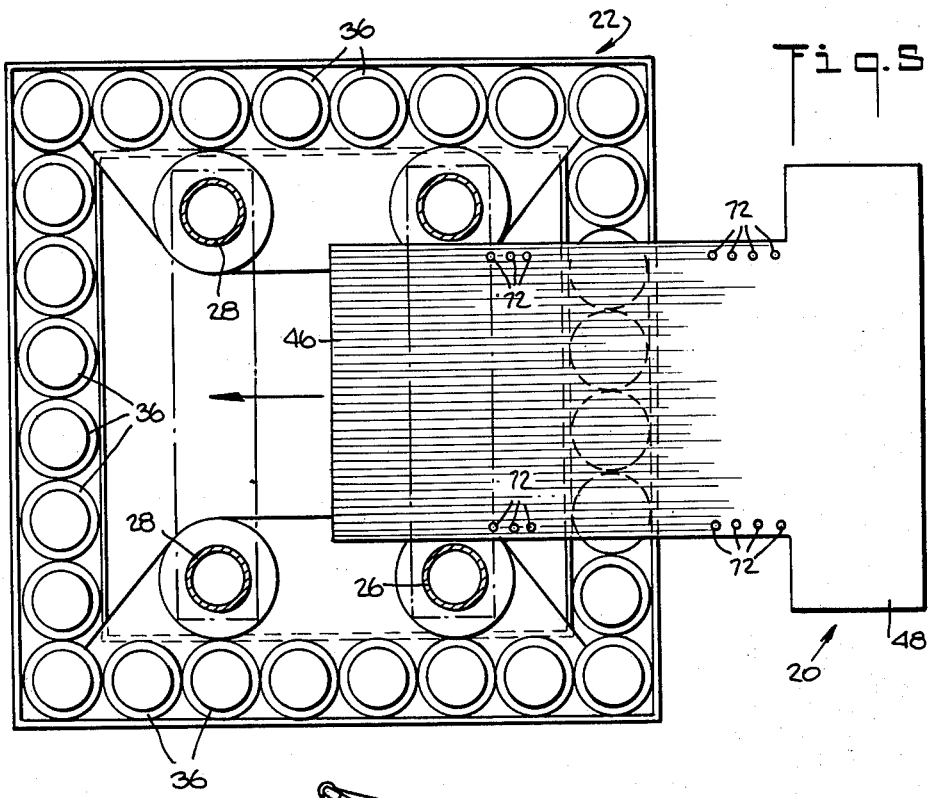
FIG. 5 is a top plan view illustrating the platform and template of FIG. 4.
Figure 6:
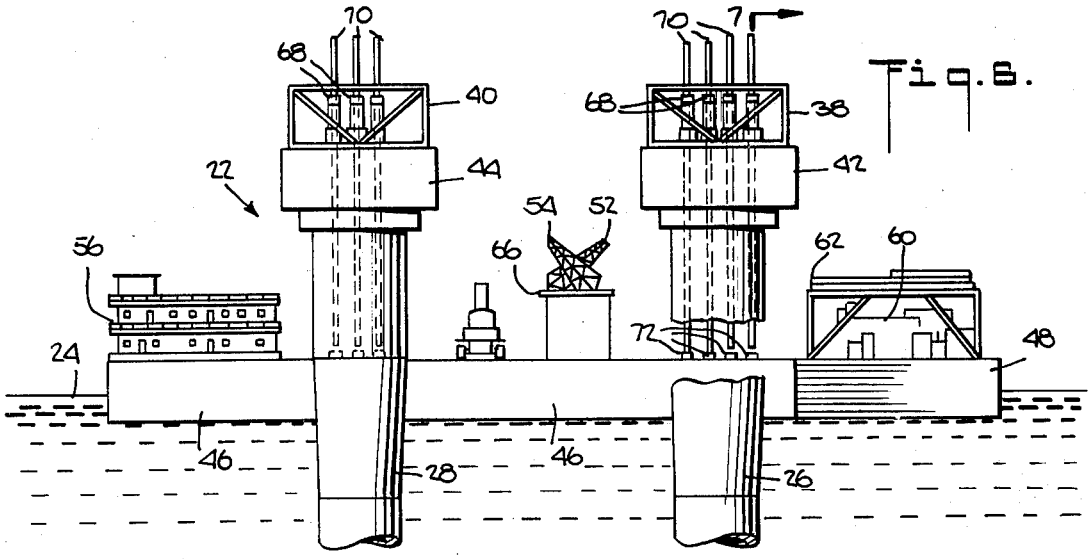
FIG. 6 is a view similar to FIG. 4 but showing the platform fully positioned at the template and ready to be raised thereon.
Figure 7:
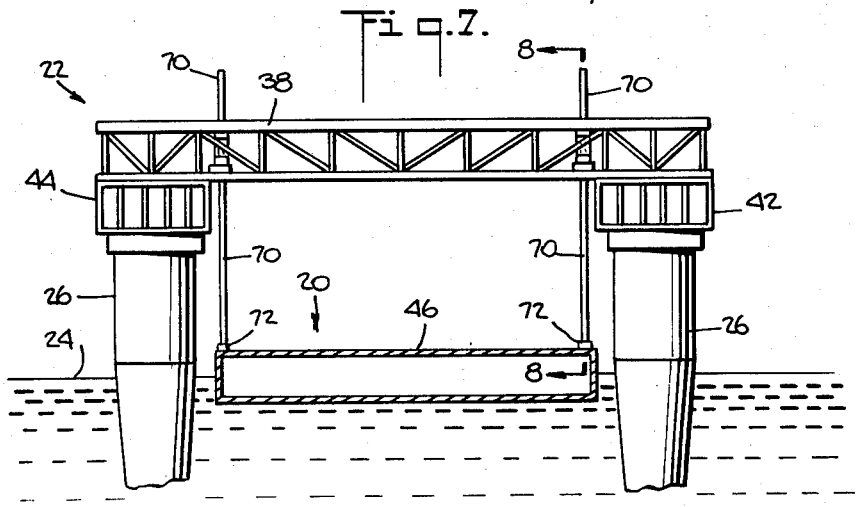
FIG. 7 is a section view taken along line 7—7 of FIG. 6.

After the template 22 has been secured to the sea bed 35, the platform 20 is towed in a floating condition, as shown in FIG. 4, to the template. The platform 20, may be fully constructed at a shore location and there outfitted with the crew quarters 56, the power generating and control equipment 60, the drill pipe storage ledge 62 and the tower and crane positioning ledge 66 with the drilling tower and tower crane 52 and 54 mounted thereon. As shown in FIG. 5, the platform is directed so that its base portion 46 first enters the region between the forward legs 26 and then continues on between and beyond the rearward legs 28 until the platform cross portion 48 nearly abuts the forward legs 26. The platform 20 is provided with jacking leg slips 72 which become aligned with the jacking legs 70 on the bridge beams 38 and 40 when the platform is floated into position. These slips are designed to allow the jacking legs to move freely through then longitudinally in one direction but to grip the legs and prevent relative movement in the opposite direction. As shown in FIG. 6, the jacking mechanism 68 are then operated to lower the jacking legs 70 until they enter their corresponding jacking leg slips 72 on the platform 22 and thereby provide an interconnection between the platform and the bridge beams 38 and 40 extending across the tops of the template legs 26 and 28.

Figure 8:
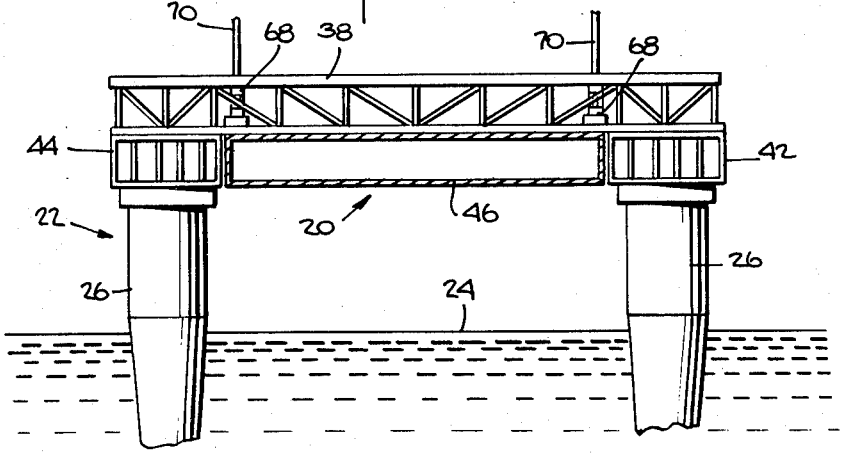
FIG. 8 is an enlarged fragmentary diagramatic view, taken along line 8—8 of FIG. 7.

As can be seen in FIG. 8 the jacking mechanisms 68 each comprise upper and lower holder assemblies 74 and 76 with the lower holder assembly 76 mounted on a portion of one of the bridge beams 38 and 40. Hydraulic piston and cylinder assemblies 78 are driven and controlled by external means (not shown) to move the holder assemblies 74 and 76 toward and away from each other. Slips 80 on the holder assemblies 74 and 76 are controlled to grip and release the jacking leg 70 in alternate sequence as the holder assemblies are moved toward and away from each other respectively. Thus, in order to lower the jacking leg 70 the slip 80 on the lower holder assemblies 76 are released while those on the upper holder assemblies 74 are engaged when the assemblies are moved toward each other and vice versa when they are moved away from each other. In order to raise the jacking leg, the slip engagement and release sequence is reversed. This is shown diagramatically in FIG. 8 by leaf type springs 81 which are held by pins 81*a* and 81*b* to bias either the upper or lower portion of the slips 80 against the jacking leg 70.

When the jacking legs 70 engage the slips 72 on the platform 20 they become secured to the platform in a manner which allows upward but not downward movement of the platform with respect to the jacking legs. That is, the slips 72 allow relative movement of the jacking legs 70 with respect to the slips which coincides with movement of the platform and bridge beam toward each other, but they prevent relative movement in the reverse direction. Thus, should the platform begin to rise as a result of wave or tide action, the slips 72 will allow the platform to move up on the jacking legs. However, the slips 72 act to prevent reverse movement. Thus, wave action is utilized in raising of the platform in a manner similar to that described in U.S. Pat. No. 3,876,181 to Joseph E. Lucas.

After the jacking legs 70 have engaged their respective jacking tube slips in the platform 20 the jacking mechanisms 68 are operated to lift the jacking legs and the platform 20 along with them to raise the platform up to the bridge beams 38 and 40 as shown in FIG. 9. When the platform is fully raised, it is secured to the bridge beams along their length, as by welding. The jacking mechanisms and jacking legs may then be removed for use in the erection of other offshore tower structures. Because of the truss-like open framework configuration of the bridge beams 38 and 40 they provide a skeletal type support which strengthens and rigifies the platform when it has been raised and secured to the bridge beams. Also, since the bridge beams span the distance between template legs the platform may be of much lighter and less rigid construction than would have been necessary if the platform had to span the template legs on its own.

Figure 10:
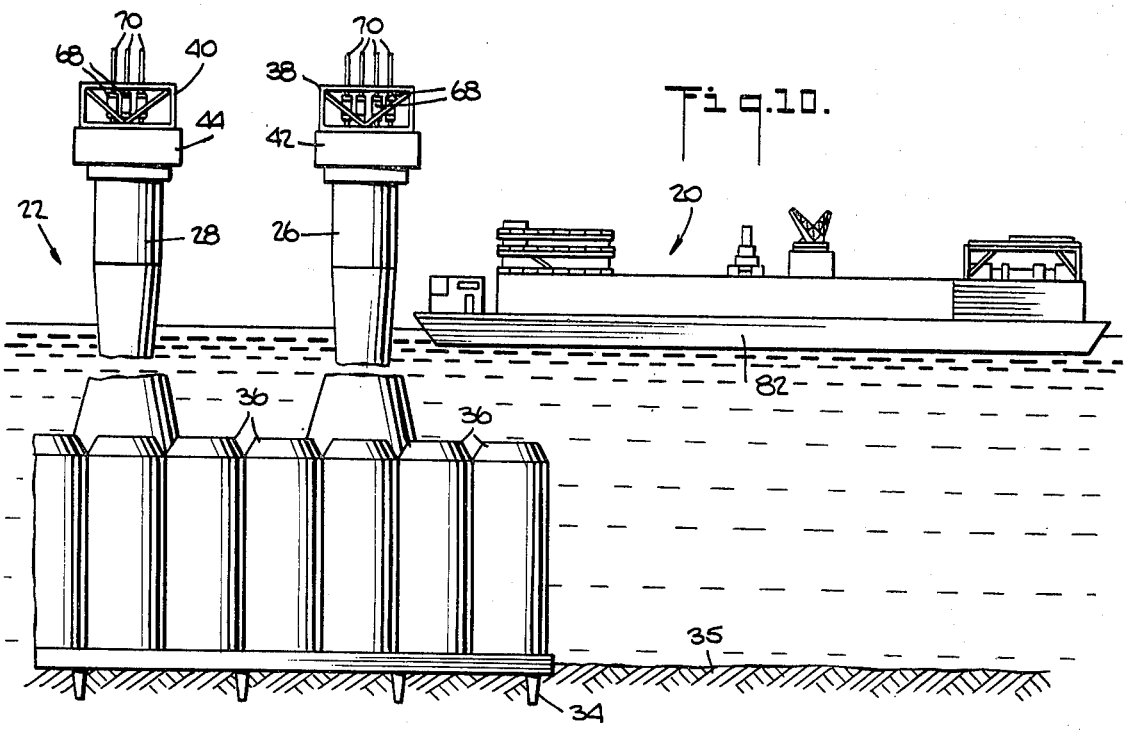
FIG. 10 is a view similar to FIG. 4 but showing the positioning of a barge mounted platform positioned at the template.
Figure 11:
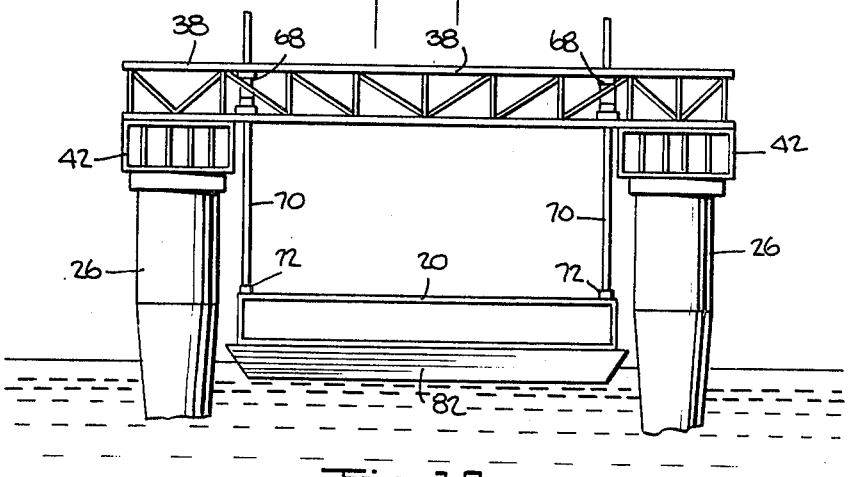
FIG. 11 is a view similar to FIG. 7 but showing a barge mounted platform.
Figure 12:
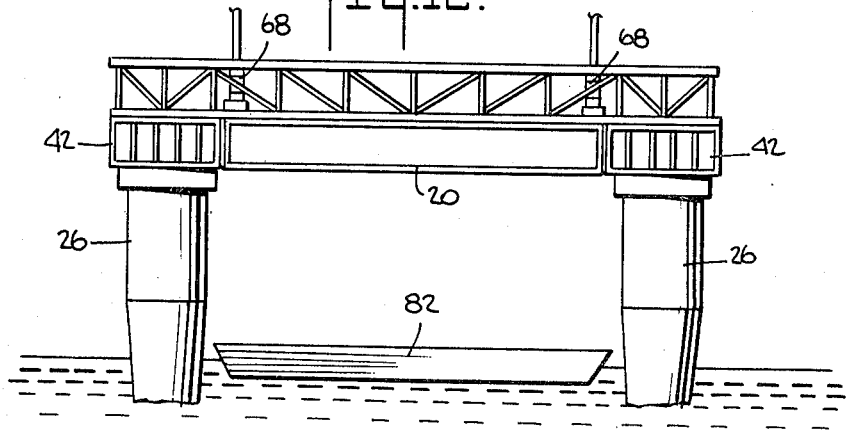
FIG. 12 is a view similar to FIG. 11 but showing a raised barge mounted platform.

FIGS. 10–12 show a modifiied arrangement wherein the platform 20 is carried out on a barge 82 to the template 22. This arrangement permits the platform to be designed without regard to bouyancy or ability to withstand the stresses of sea action. As shown in FIG. 11 the jacking legs 70 are engaged in the jacking tube slips 72 on the platform while it is supported by the barge 82; and as shown in FIG. 12 the jacking mechanisms 68 operate to lift the platform up off the barge to the bridge beams 38 and 40 for subsequent attachment thereto. The jacking mechanisms and jacking legs 68 and 70 may then be disconnected and lowered back down to the barge for use in the erection of another offshore tower structure.

Figure 13:
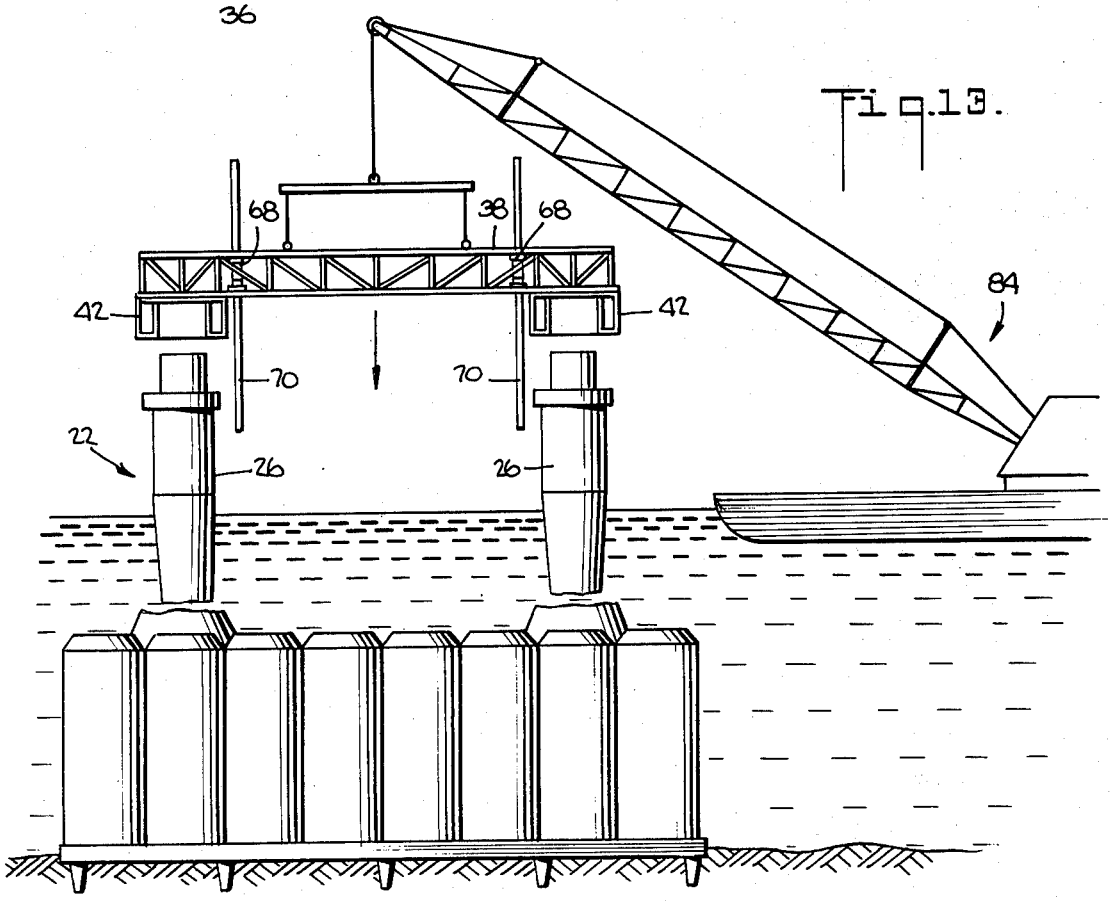
FIG. 13 illustrates a modified arrangement whereby a bridge beam is mounted atop a previously installed template.

FIG. 13 shows another modification wherein the template 22 is floated to location and installed there prior to installation of the bridge beams 38 and 40. These beams may then be installed by means of a derrick barge 84. As shown, the jacking mechanisms and jacking legs 68 and 70 may be previously mounted on the bridge beams so that the entire bridge beam and jacking assembly may be positioned on top of the template legs 26 and 28. Because the bridge beams are of open framework construction they may be handled by a derrick barge rather easily, as compared to the platform itself.

Figure 14:
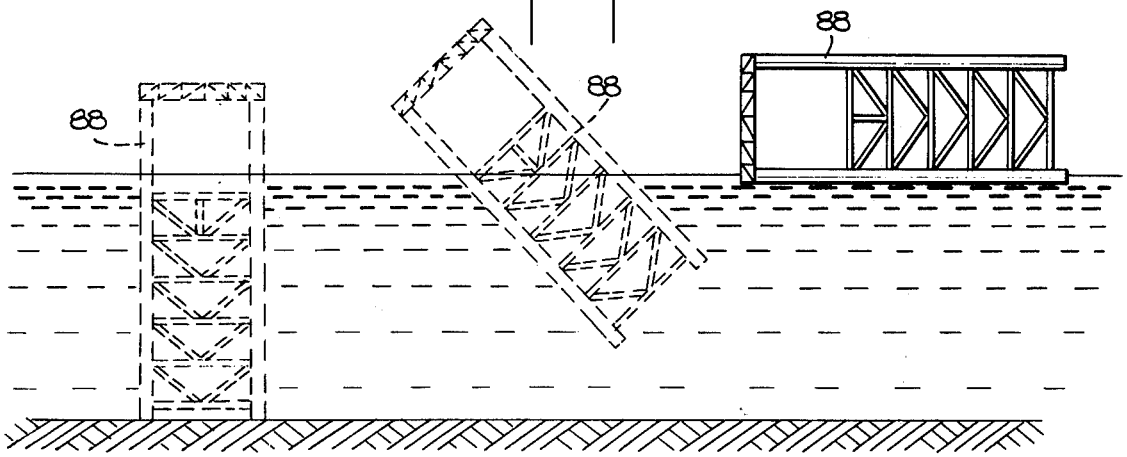
FIG. 14 illustrates a modified arrangement wherein a tilt-up type template is installed.
Figure 8:
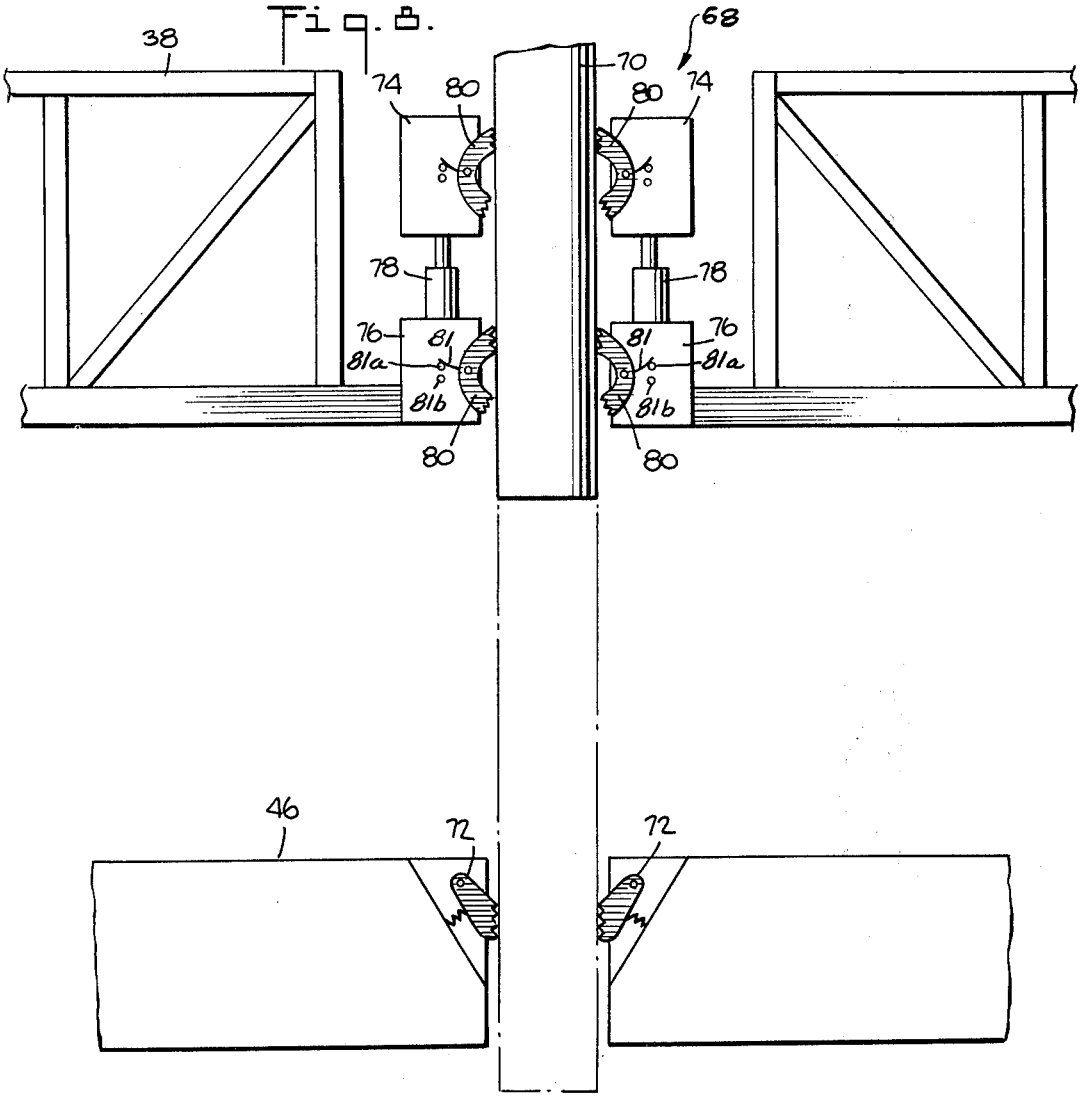

FIG. 14 shows the installation of a tilt-up type template 86 with preassembled bridge beams 88. The basic idea of horizontally floatable template which is tilted to upright position by selective flooding is well known and is shown for example, in U.S. Pat. No. 2,857,744 to W. F. Swiger, et al. In that patent a temporary truss 22 is shown attached to the upper ends of the template legs; however, it is believed that the present invention represents the first time that bridge beams have been used in the lifting and reinforcing of a platform structure.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A method of erecting an offshore tower, said method comprising the steps of positioning a template, having at least one vertical template leg, on a sea floor so that said vertical leg extends up above the sea level, said template being provided with jacking mechanism mounting means connected to the upper end of said template leg, moving a platform into position adjacent the template leg; connecting at least one jacking leg to extend down from an associated jacking mechanism on said mounting means and to be connected to said platform and then operating said jacking mechanism to pull said jacking leg upwardly to raise said platform clear of the water.

2. A method of erecting an offshore tower according to claim 1 wherein said jacking mechanism is provided on said template prior to positioning said template on the sea floor.

3. A method of erecting an offshore tower according to claim 1 wherein said template is positioned by floating same to a predetermined location in the sea, with said jacking mechanism secured thereto.

4. An offshore tower construction comprising a template constructed to be anchored to a sea floor, said template including at least one vertical template leg which extends up above the surface of the sea when said template is secured to the sea floor, a mounting member connected to the upper end of at least said one template leg, a platform member constructed to be positioned adjacent said template leg and to be lifted upwardly therealong clear of the water, a jacking mechanism secured to said mounting means on said template leg and a jacking leg extending from said jacking mechanism down to said platform and secured thereto whereby operation of said jacking mechanism pulls up said jacking leg and lifts said platform clear of the water.

* * * * *